US009561683B2

(12) United States Patent
O'Connor

(10) Patent No.: US 9,561,683 B2
(45) Date of Patent: Feb. 7, 2017

(54) COMPACT CONVERTIBLE WRITING INSTRUMENT WITH INTERCHANGEABLE MULTI-FUNCTIONAL COMPONENTS

(71) Applicant: Terrence G. O'Connor, Westfield, NJ (US)

(72) Inventor: Terrence G. O'Connor, Westfield, NJ (US)

(73) Assignee: Pokka LLC, Westfield, NJ (US)

( * ) Notice: Subject to any disclaimer, the term of this patent is extended or adjusted under 35 U.S.C. 154(b) by 55 days.

(21) Appl. No.: 14/726,053

(22) Filed: May 29, 2015

(65) Prior Publication Data

US 2016/0075169 A1 Mar. 17, 2016

Related U.S. Application Data

(60) Provisional application No. 62/049,474, filed on Sep. 12, 2014.

(51) Int. Cl.

| | |
|---|---|
| ***B43K 29/00*** | (2006.01) |
| ***B43K 23/12*** | (2006.01) |
| ***B43K 29/20*** | (2006.01) |
| ***B43K 29/08*** | (2006.01) |
| ***B43K 23/00*** | (2006.01) |

(52) U.S. Cl.

CPC ..... *B43K 23/12* (2013.01); *B43K 23/001* (2013.01); *B43K 29/004* (2013.01); *B43K 29/08* (2013.01); *B43K 29/20* (2013.01)

(58) Field of Classification Search

CPC ..... B43K 29/20; B43K 29/08; B43K 29/004; B43K 23/12; B43K 23/001

USPC ..... 401/116, 117, 195, 107, 213, 243

See application file for complete search history.

(56) References Cited

U.S. PATENT DOCUMENTS

| | | | | |
|---|---|---|---|---|
| 2,318,171 | A * | 5/1943 | Lipic, Jr. | B43K 23/00 401/88 |
| 2,896,576 | A * | 7/1959 | Baer | B26B 11/001 30/161 |
| 4,833,902 | A | 5/1989 | Mori | |
| 4,974,982 | A | 12/1990 | Nielson | |
| 5,174,672 | A | 12/1992 | Towsend | |
| 5,638,566 | A * | 6/1997 | Wu | B25F 1/02 401/18 |
| 6,264,389 | B1 | 7/2001 | Ducharme | |
| D509,537 | S * | 9/2005 | Bianchi | D19/157 |
| 7,168,105 | B2 * | 1/2007 | Adelman | B43K 5/005 401/195 |
| 7,401,992 | B1 * | 7/2008 | Lin | B43K 23/126 401/131 |

* cited by examiner

*Primary Examiner* — Jennifer C Chiang

(74) *Attorney, Agent, or Firm* — Thomas J. Germinario

(57) ABSTRACT

A convertible writing instrument can be put into either a compact capped configuration, 3 to 4 inches in length, or an extended writing configuration, 5 to 6 inches in length. A relatively elongated cap, which covers most of the relatively shortened pen member in the compact configuration, can be re-attached to the back of the pen, so as to lengthen the instrument in preparation for writing. Multiple interchangeable caps and rear modules can be coupled to the pen member to provide a variety of appearances and functions.

13 Claims, 8 Drawing Sheets

COMPACT CONVERTIBLE WRITING INSTRUMENT WITH INTERCHANGEABLE MULTI-FUNCTIONAL COMPONENTS

REFERENCE TO RELATED APPLICATION

This application claims the benefit of the filing date of U.S. provisional patent application No. 62/049,474, filed Sep. 12, 2014, the disclosure of which is incorporated herein by reference.

FIELD OF INVENTION

The present invention relates generally to the field of writing instruments and, more particularly, to a writing instrument that is convertible from a compact capped configuration, in which a shortened writing barrel is fully enclosed by one of multiple interchangeable elongated caps, to an extended writing configuration, in which the elongated cap is reattached to the back end of the writing barrel.

BACKGROUND OF THE INVENTION

Conventional writing instruments, such as ball-point pens, have several limitations that limit their utility. When capped for storage and/or transport, they are 5"-6" long—too long to fit into a shirt pocket without protruding, and too long to be comfortably stowed in a pants pocket. Since the longer writing barrel, as compared to the shorter cap, dominates the appearance of the instrument, the ability to use interchangeable components to change the appearance and/or functions of a conventional writing instrument is very limited. Because the potentially fungible cap is structurally and dimensionally subordinate to the non-fungible writing barrel, the opportunity to employ a variety of interchangeable caps with different visual, attachment and/or other functional features is foreclosed.

Moreover, the conventional writing instrument configuration, with its dominant writing barrel, often requires that the entire instrument be discarded when its ink supply is depleted. In a cap-dominant configuration, on the other hand, the shortened writing barrel itself becomes a secondary, disposable component, which is readily and inexpensively replaceable.

Finally, the dual coupling means, required for switching the elongated cap from frontal to rear connection on the writing barrel, enables various additional functional components to be attached to the back end of the writing instrument in its compact capped configuration, thereby expanding the versatile utility of the instrument.

SUMMARY OF THE INVENTION

The writing instrument of the present invention comprises a pen member and multiple interchangeable cap members. As used herein, the term "pen" is not limiting, but refers to any type of writing instrument or marker which utilizes a pigment-based or dye-based ink as a medium for writing, printing, marking, drawing, and/or coloring. As used herein, the term "proximal" refers to the direction toward the writing tip of the pen member or toward the open end of the cap member. The term "distal" refers to the direction away from the writing tip of the pen member or toward the closed end of the cap member.

The pen member has a front (proximal) end, containing a substantially conical writing tip, and a back (distal) end, adjoining a dual coupling means. Between the front/proximal and rear/distal ends of the pen member extends a substantially tubular or tapered tubular pen barrel, containing within it an axially-disposed, substantially tubular ink reservoir, which fluidly communicates with the writing tip. The ink reservoir and the writing tip can be provided as integral components of a replaceable ink cartridge inserted into the hollow interior of the pen barrel.

The dual coupling means comprise a first coupling means, nearer to the front/proximal end of the pen member, and a second coupling means, nearer to the back/distal end of the pen member. The dual coupling means divide the pen member into a longer forward stem, extending from the writing tip to the first coupling means, and a shorter rear stem, extending from the second coupling means to the back/distal end.

Multiple interchangeable cap members each comprise a substantially tubular or tapered tubular cap body with an open proximal end and a closed distal end. Each of the cap members is dimensioned and configured to enclose the entire forward stem of the pen member, so that only the shorter rear stem of the pen member protrudes from the open proximal end of the cap member when the writing instrument is in the compact capped configuration.

Each of the cap members has within its open proximal end a third coupling means, which cooperates and conjugately mates alternately with either the first coupling means or the second coupling means of the pen member. When attached to the first coupling means, the cap member puts the writing instrument into its compact capped configuration, as described above. When attached to the second coupling means, the cap member encloses only the shorter rear stem of the pen member, with the longer forward stem protruding from the open proximal end of the cap member, and the writing instrument is in an extended writing configuration of sufficient length to comfortably fit the hand for writing purposes.

Advantageously, the interchangeable cap members can incorporate a variety of materials, textures, colors, indicia and/or graphic designs, thereby allowing the writing instrument to be customized for various uses, events, occasions, enterprises, entities and/or organizations that are identified with such materials, textures, colors, indicia and/or graphic designs. For example, an advertising agency could have a supply of caps with the corporate colors and logos of its various clients, while a banquet hall could have caps with materials, textures, colors and graphics corresponding to various occasions, such as weddings or holidays.

The interchangeable cap members can also incorporate a variety of cap attachment means, whereby the writing instrument can be removably attached or secured to one or more external objects for purposes of storage and/or transport. Examples of such cap attachments means are clips, holes, hooks, magnets, suction cups, and hook-and-loop fasteners. Moreover, the interchangeable cap members can incorporate a variety of functional elements, not related to attachment, which are operable to perform various non-writing tasks. Examples of such non-attachment functional elements include a stylus (for activating touch-screen devices), a flashdrive (for digital files), a flashlight, a laser pointer, and an eraser.

The first and second coupling means near the distal end of the pen member are configured to cooperate conjugately with the third coupling means at the open proximal end of the cap members. These coupling means can comprise such systems as threading, friction fit, snap fit, or bayonet mounts. Preferably, the first and second coupling means comprise protruding O-rings, which fit into a conjugate recessed detent (the third coupling means) near the open proximal end of the cap members.

When the writing instrument is in the compact capped configuration (i.e., with one of the cap members attached to the first coupling means), the second coupling means is available for conjugate connection to one of multiple interchangeable rear modules, which incorporate a variety of functional elements operable to perform various non-writing tasks. For example, the rear modules can include any of the attachment means and/or non-attachment functional elements enumerated above, thereby enhancing the convenience and versatility of the writing instrument in its compact capped configuration.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1A:
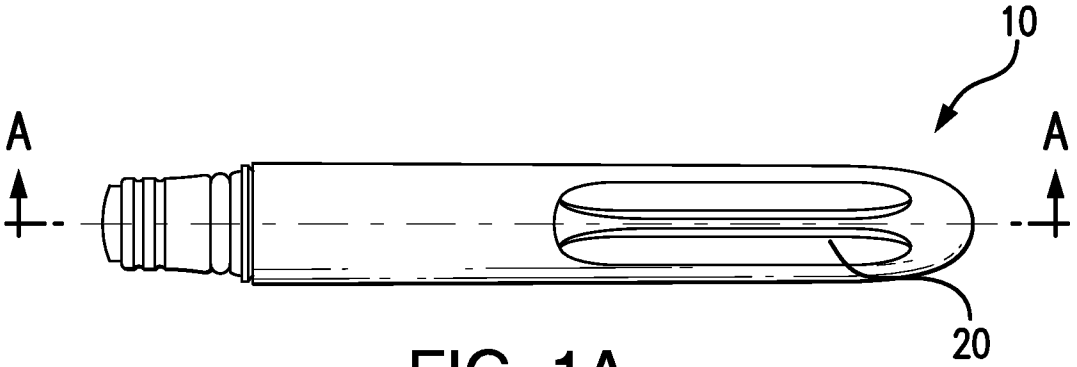
FIG. 1A is a profile view of one embodiment of the writing instrument in the compact capped configuration.
Figure 1B:
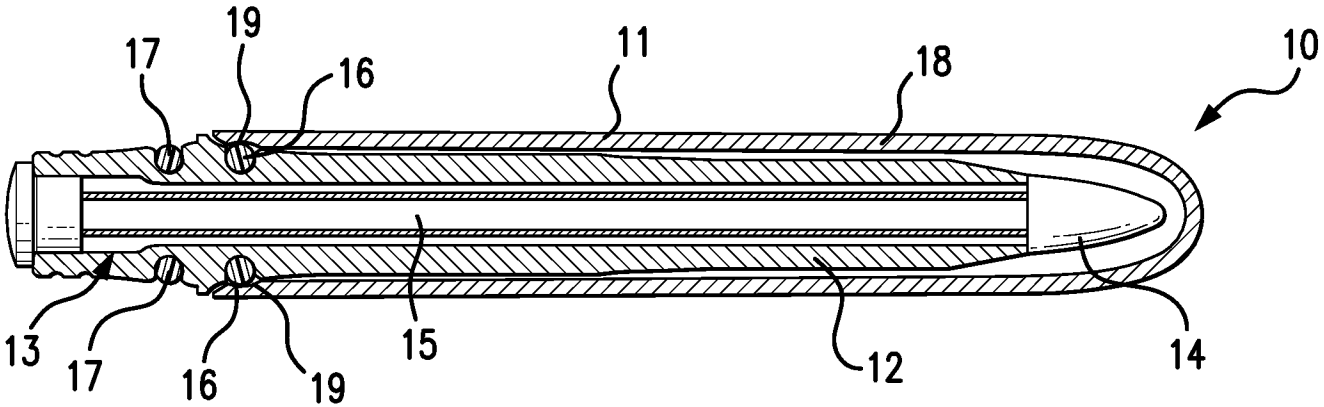
FIG. 1B is a magnified cross-section view of the writing instrument of FIG. 1A, taken along the line A-A.

FIGS. 1A and 1B depict an exemplary writing instrument in its compact capped configuration 10. The pen member 11 comprises a tapered tubular pen barrel 12, having within its hollow interior a replaceable ink cartridge 13 with a conical writing tip 14 and a tubular ink reservoir 15. Near its distal end, the instrument has dual O-ring couplers, comprising a first O-ring coupler 16, nearer the proximal end of the pen member 11, and a second O-ring coupler 17, nearer the distal end of the pen member 11.

Figure 2:
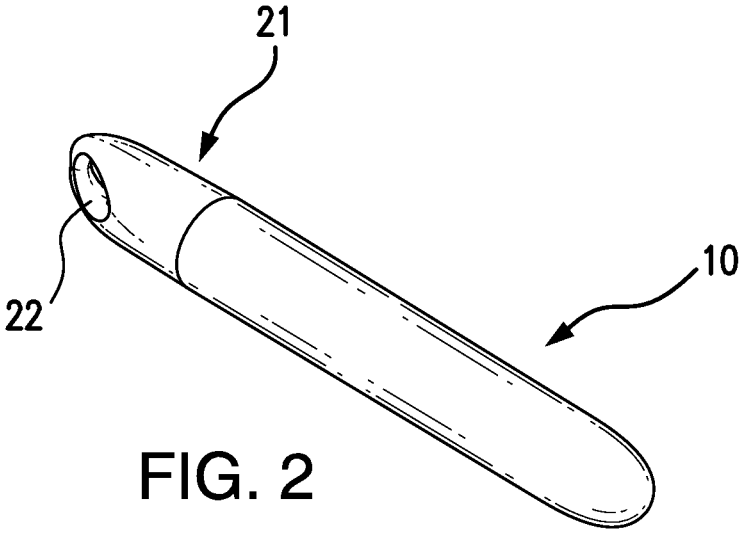
FIG. 2 is a perspective view of one embodiment of the writing instrument in the compact capped configuration, with a rear module containing a hole attachment means.

One of multiple interchangeable cap members 18 is shown conjugately connected, by means of a detent 19 near its open end, to the first O-ring coupler 16. The cap member 18 has a clip attachment 20 near its closed end. The overall length of the exemplary writing instrument in its compact capped configuration 10 will typically range from 3 to 4 inches. Referring to FIG. 2, the compact capped configuration 10 is shown with one of multiple rear modules 21 connected, by means of a conjugate detent, to the second O-ring coupler 17. The exemplary rear module 21 contains a hole 22 to accommodate attachment of the compact capped writing instrument 10 to a key ring or lanyard (not shown).

Figure 4:
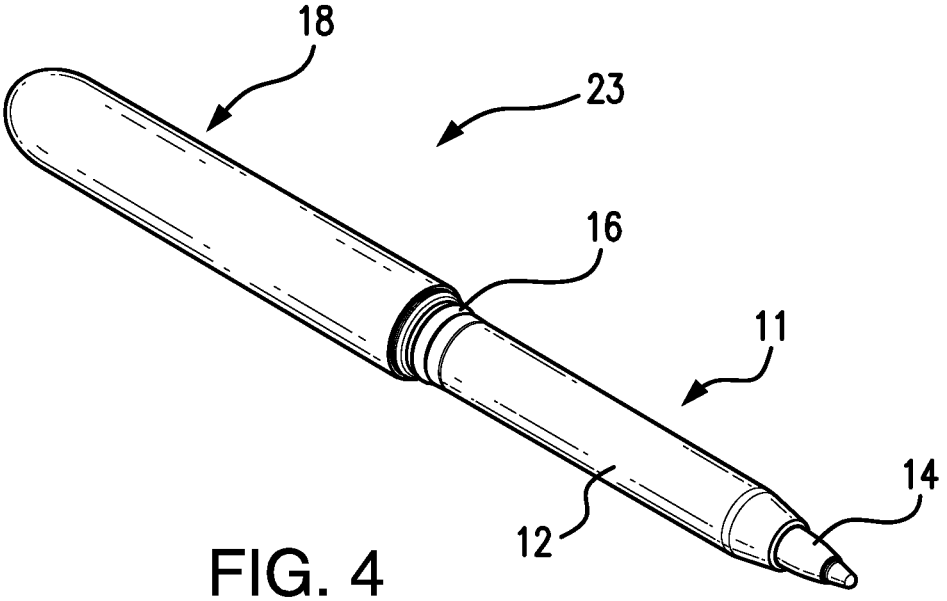
FIG. 4 is a perspective view of one embodiment of the writing instrument in the extended writing configuration.
Figure 3A:
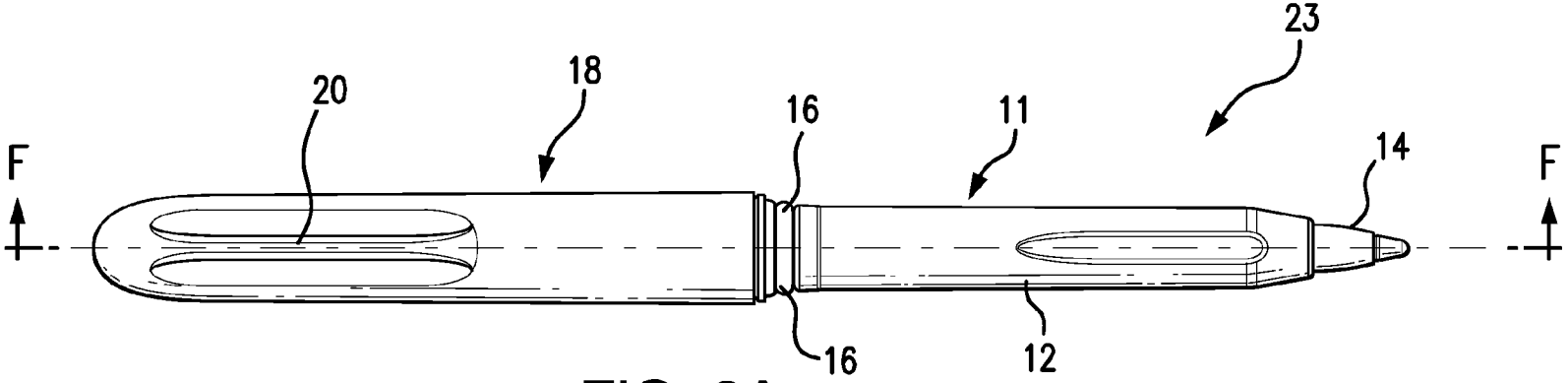
FIG. 3A is a profile view of one embodiment of the writing instrument in the extended writing configuration.
Figure 3B:
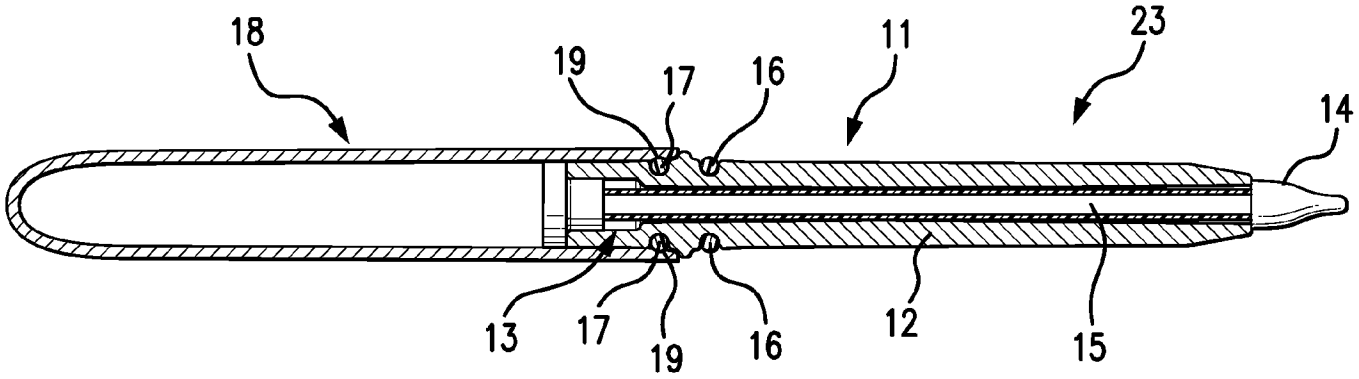
FIG. 3B is a cross-section view of the writing instrument of FIG. 3A, taken along the line F-F.

FIGS. 3A and 3B depict an exemplary writing instrument in its extended writing configuration 23. One of the interchangeable cap members 18 is shown conjugately connected, by means of its detent 19, to the second O-ring coupler 17. The overall length of the exemplary writing instrument in its extended writing configuration 23 will typically range from 5 to 6 inches. FIG. 4 presents a perspective view of the writing instrument in its extended writing configuration 23.

Figure 5:
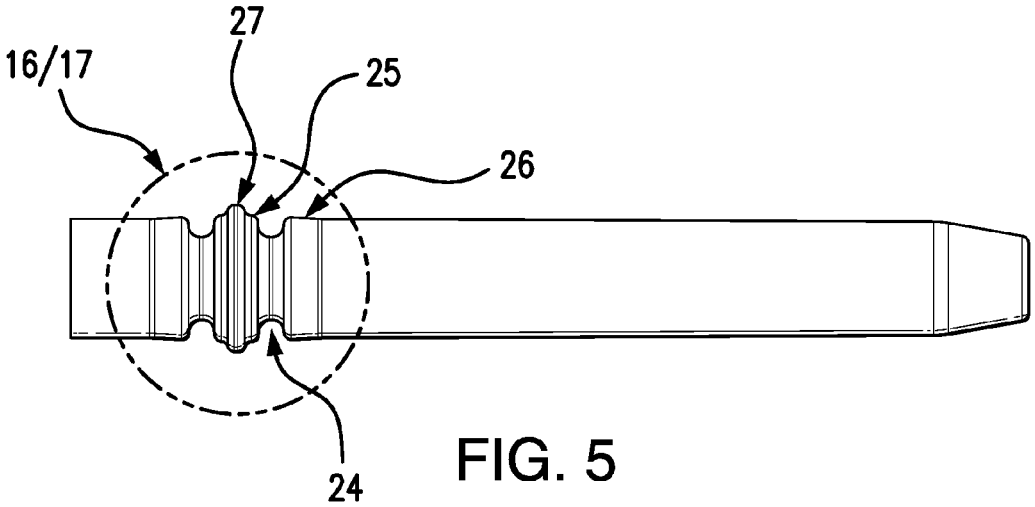
FIG. 5 is a detail profile view of the first and second coupling means of the pen member.

Referring to FIG. 5, an exemplary embodiment of the first and second O-ring couplers 16 17 is illustrated (for greater clarity, the O-rings themselves are not shown). Each O-ring coupler 16 17 comprises an O-ring groove 24 adjoined on either side by a shorter shoulder 25 and a longer shoulder 26. Midway between the two shorter shoulders 25 is a central stop ring 27, which separates the two couplers 16 17, so that the cap members 18 can dock with only one coupler at a time.

Figure 6:
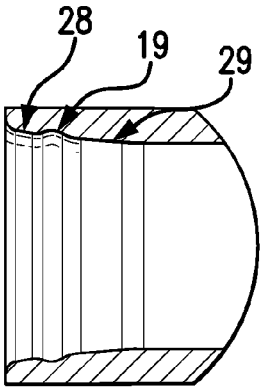
FIG. 6 is a detail profile view of the third coupling means of the cap member(s)

Referring to FIG. 6, an exemplary conjugate detent coupler 19 of one of the cap members 18 is shown. The O-ring detent 19 is adjoined on the proximal side by a shorter shoulder ramp 28, which is sized and configured to snuggly interface alternately with either of the shorter shoulders 25 of the first or second O-ring couplers 16 17. The O-ring detent 19 is adjoined on the distal side by a longer shoulder ramp 29, which is sized and configured to snuggly interface alternately with either of the longer shoulders 26 of the first or second O-ring couplers 16 17.

Figure 7A:
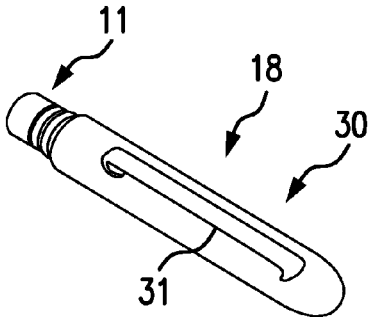
FIGS. 7A-7F are perspective views of six exemplary interchangeable cap members incorporating alternative cap attachment means.
Figure 7D:
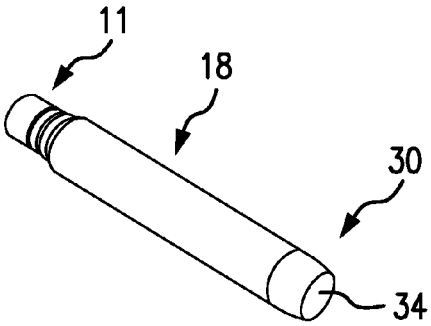
Figure 7B:
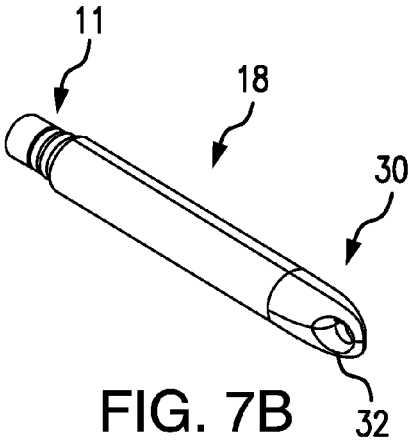
Figure 7E:
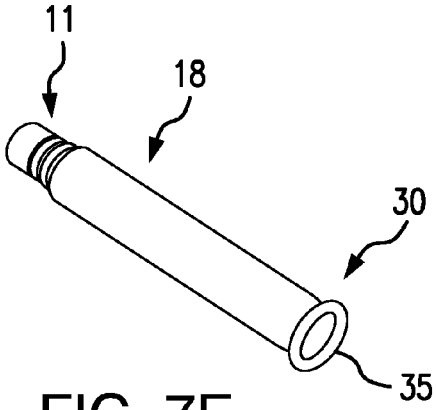
Figure 7C:
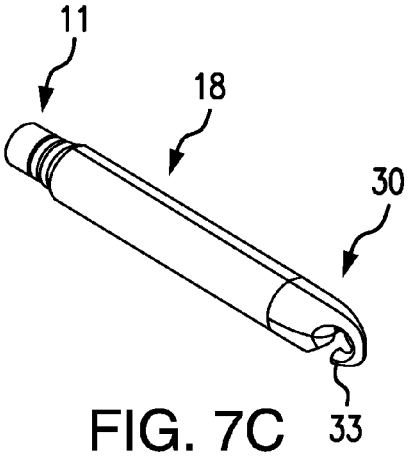
Figure 7F:
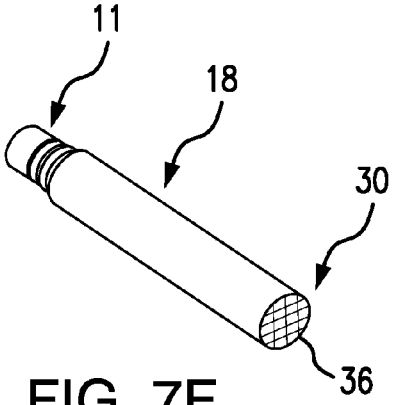
Figure 8A:
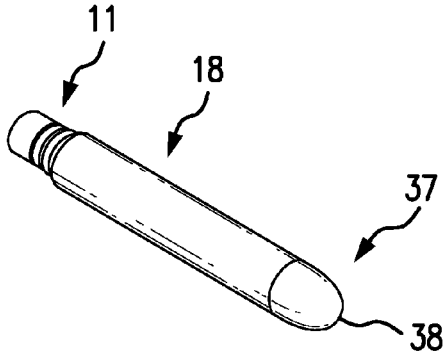
FIGS. 8A-8E are perspective views of five exemplary interchangeable cap members incorporating alternative non-attachment functional elements.
Figure 8D:
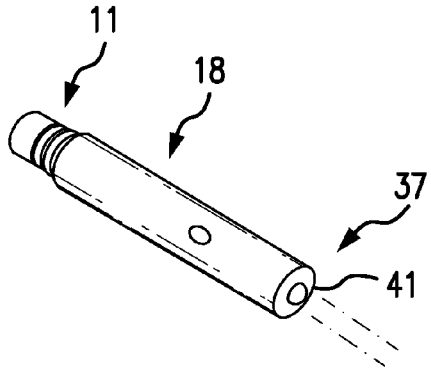
Figure 8B:
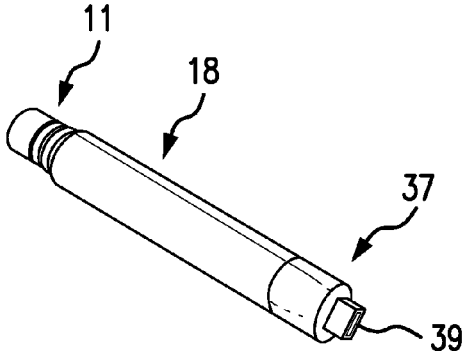
Figure 8E:
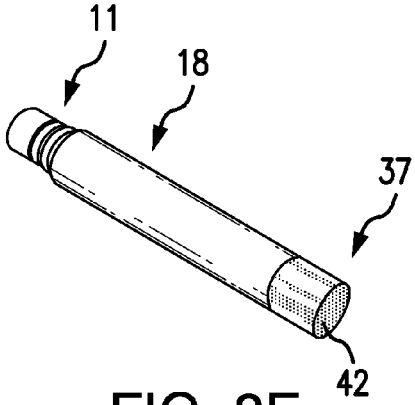
Figure 8C:
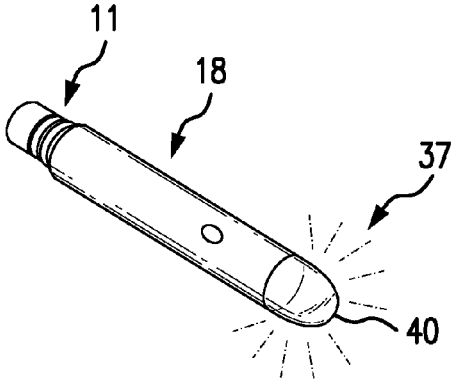
Figure 9A:
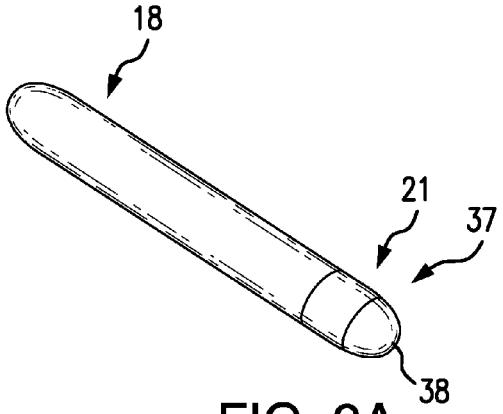
FIGS. 9A-9E are perspective views of five exemplary interchangeable rear modules incorporating alternative non-attachment functional elements.
Figure 9D:
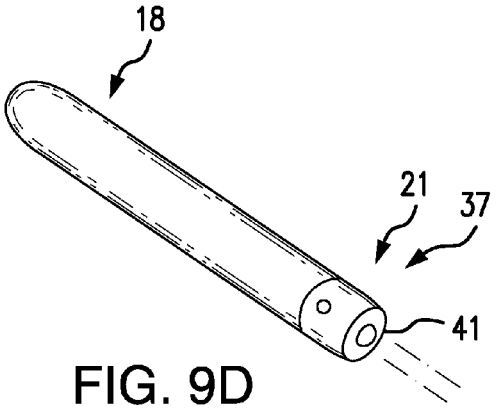
Figure 9B:
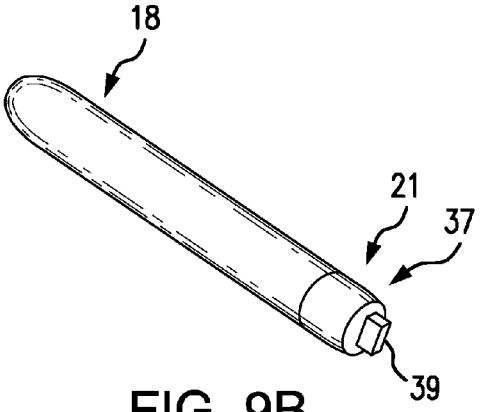
Figure 9E:
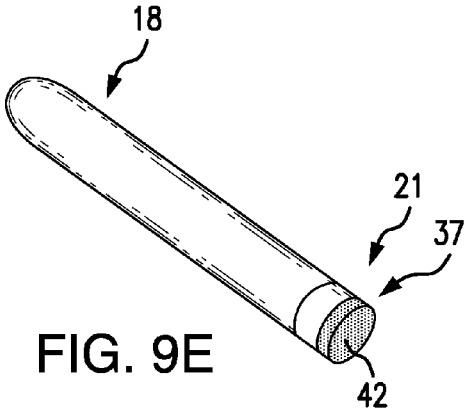
Figure 9C:
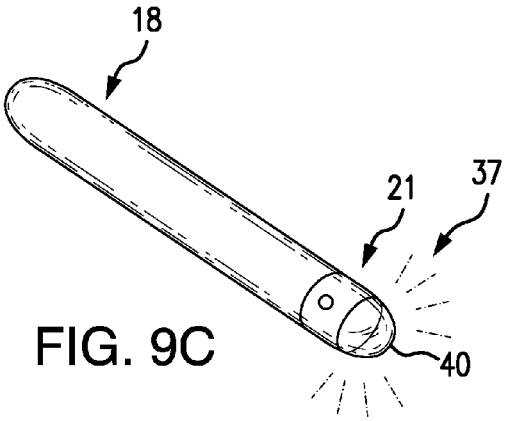

FIGS. 7A-7F depict six exemplary interchangeable cap members 18 incorporating alternative cap attachment means 30, consisting of a clip 31 (FIG. 7A), a hole 32 (FIG. 7B), a hook 33 (FIG. 7C), a magnet 34 (FIG. 7D), a suction cup 35 (FIG. 7E), and a hook-and-loop fastener 36 (FIG. 7F). The cap attachment means 30 allow the writing instrument 10 to be secured to external objects or structures for purposes of storage and/or transport.

FIGS. 8A-8E depict five exemplary interchangeable cap members 18 incorporating alternative non-attachment functional elements 37, consisting of a stylus 38 (FIG. 8A), a flash-drive 39 (FIG. 8B), a flashlight 40 (FIG. 8C), a laser pointer 41 (FIG. 8D), and an eraser 42 (FIG. 8E), which enable the instrument 10 to perform non-writing tasks.

FIGS. 9A-9E depict five exemplary interchangeable rear modules 21 incorporating alternative functional elements 37, consisting of a stylus 38 (FIG. 9A), a flash-drive 39 (FIG. 9B), a flashlight 40 (FIG. 9C), a laser pointer 41 (FIG. 9D), and an eraser 42 (FIG. 9E), which enable the instrument 10 to perform non-writing tasks.

Figure 10A:
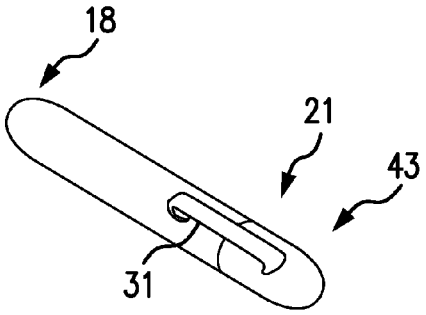
FIGS. 10A-10F are perspective views of six exemplary interchangeable rear modules incorporating alternative rear module attachment means.
Figure 10D:
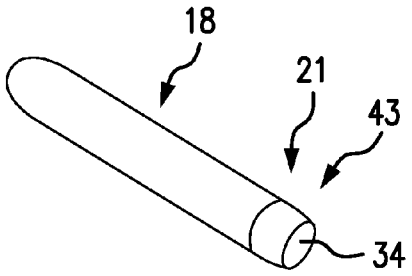
Figure 10B:
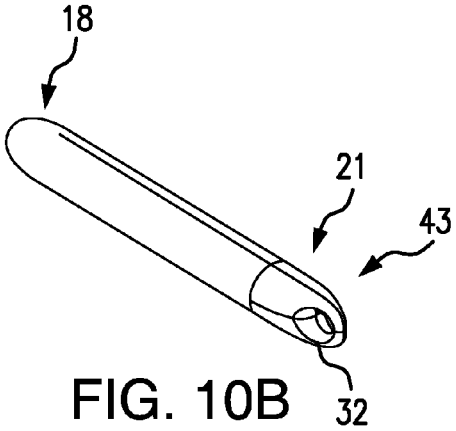
Figure 10E:
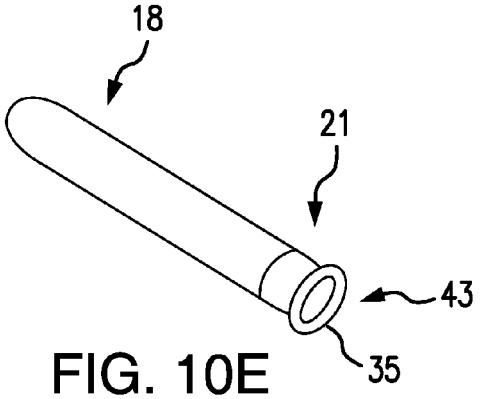
Figure 10C:
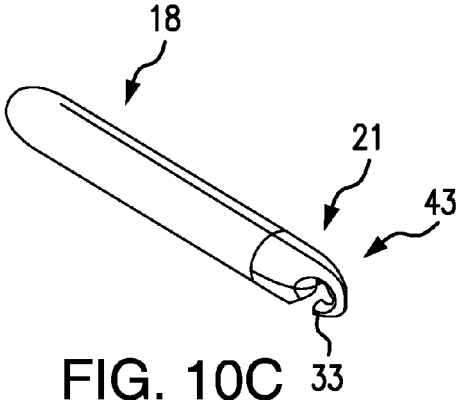
Figure 10F:
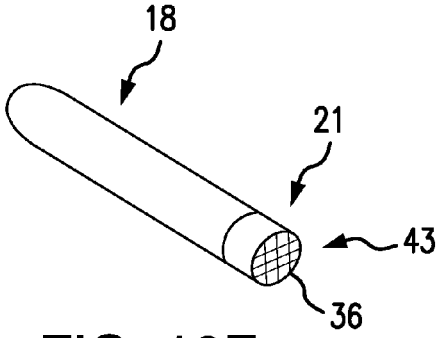

FIGS. 10A-10F depict six exemplary interchangeable rear modules 21 incorporating alternative rear module attachment means 43, consisting of a clip 31 (FIG. 10A), a hole 32 (FIG. 10B), a hook 33 (FIG. 10C), a magnet 39 (FIG. 10D), a suction cup 35 (FIG. 10E), and a hook-and-loop fastener 36 (FIG. 10F). The rear module attachment means 43 allow the writing instrument 10 to be secured to external objects or structures for purposes of storage and/or transport.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A writing apparatus, comprising:

a pen member, comprising a proximal end and a distal end, and further comprising, between the proximal end and the distal end, a tubular or tapered tubular pen barrel, containing a tubular ink reservoir axially disposed within the pen barrel, wherein the ink reservoir fluidly communicates with a conical writing tip at the proximal end of the pen member, and further comprising a first coupling means and a second coupling means proximate to the distal end of the pen member;

wherein the pen member further comprises a longer forward stem, having a forward stem length and extending from the proximal end to the first coupling means, and a shorter rear stem, having a rear stem length and extending from the distal end to the second coupling means;

multiple interchangeable cap members, each cap member comprising an open proximal end and closed distal end, and further comprising, between the proximal end and the distal end, a tubular or tapered tubular cap body, wherein the cap body has a length that is approximately equal to the forward stem length;

wherein the proximal end of each cap member contains a third coupling means, which is configured to removably and conjugately attach alternately to either the first coupling means or the second coupling means of the pen member;

wherein each cap member is configured to receive axially within the cap body the entire forward stem of the pen member when the third coupling means is attached to the first coupling means, so that the writing apparatus is put into a compact capped configuration adapted to storage and/or transport; and wherein each cap member is configured to receive axially within the cap body the entire rear stem of the pen member when the third coupling means is attached to the second coupling means, so that the writing apparatus is put into an extended writing configuration adapted to manual manipulation for writing purposes.

2. The writing apparatus of claim 1, wherein each of the interchangeable cap members incorporates one or more indicia, materials, textures, colors, and/or graphic designs, whereby the writing apparatus is adaptable to various uses, events, occasions, enterprises, entities and/or organizations that are identified with specific indicia, materials, colors, textures and/or graphic designs.

3. The writing apparatus of either of claim 1 or 2, wherein each of the interchangeable cap members incorporates one or more cap attachment means, whereby the writing apparatus is adaptable to being secured to one or more external objects or structures for purposes of storage and/or transport.

4. The writing apparatus of either of claim 1 or 2, wherein each of the interchangeable cap members incorporates one or more non-attachment functional elements means, which are operable to perform various non-writing tasks.

5. The writing apparatus of claim 3, wherein each of the interchangeable cap members incorporates one or more non-attachment functional elements means, which are operable to perform various non-writing tasks.

6. The writing apparatus of either of claim 1 or 2, wherein the writing apparatus further comprises multiple interchangeable rear modules, which are removably and conjugately attachable to the second coupling means, when the writing apparatus is in the compact capped configuration, and wherein each of the interchangeable rear modules incorporates one or more rear module attachment means and/or one or more non-attachment functional elements means, which are operable to perform various non-writing tasks.

7. The writing apparatus of claim 3, wherein the writing apparatus further comprises multiple interchangeable rear modules, which are removably and conjugately attachable to the second coupling means, when the writing apparatus is in the compact capped configuration, and wherein each of the interchangeable rear modules incorporates one or more rear module attachment means and/or one or more non-attachment functional elements means, which are operable to perform various non-writing tasks.

8. The writing apparatus of claim 4, wherein the writing apparatus further comprises multiple interchangeable rear modules, which are removably and conjugately attachable to the second coupling means, when the writing apparatus is in the compact capped configuration, and wherein each of the interchangeable rear modules incorporates one or more rear module attachment means and/or one or more non-attachment functional elements means, which are operable to perform various non-writing tasks.

9. The writing apparatus of claim 5, wherein the writing apparatus further comprises multiple interchangeable rear modules, which are removably and conjugately attachable to the second coupling means, when the writing apparatus is in the compact capped configuration, and wherein each of the interchangeable rear modules incorporates one or more rear module attachment means and/or one or more non-attachment functional elements means, which are operable to perform various non-writing tasks.

10. A writing apparatus, comprising:

a pen member, comprising a proximal end and a distal end, and further comprising, between the proximal end and the distal end, a tubular or tapered tubular pen barrel, containing a tubular ink reservoir axially disposed within the pen barrel, wherein the ink reservoir fluidly communicates with a conical writing tip at the proximal end of the pen member, and further comprising a first coupling means and a second coupling means proximate to the distal end of the pen member;

wherein the pen member further comprises a longer forward stem, having a forward stem length and extending from the proximal end to the first coupling means, and a shorter rear stem, having a rear stem length and extending from the distal end to the second coupling means;

one or more cap members, each cap member comprising an open proximal end and closed distal end, and further comprising, between the proximal end and the distal end, a tubular or tapered tubular cap body, wherein the cap body has a length that is approximately equal to the forward stem length;

wherein the proximal end of each cap member contains a third coupling means, which is configured to removably and conjugately attach alternately to either the first coupling means or the second coupling means of the pen member;

wherein each cap member is configured to receive axially within the cap body the entire forward stem of the pen member when the third coupling means is attached to the first coupling means, so that the writing apparatus is put into a compact capped configuration adapted to storage and/or transport;

wherein each cap member is configured to receive axially within the cap body the entire rear stem of the pen member when the third coupling means is attached to the second coupling means, so that the writing apparatus is put into an extended writing configuration adapted to manual manipulation for writing purposes; and wherein the first coupling means comprises an annular first groove, having a proximal side and a distal side and containing a first O-ring, having an O-ring diameter, wherein the first groove has an axial first groove width, and wherein an annular first distal shoulder, which tapers toward the first groove, is located adjacent to the distal side of the first groove and has an axial width less than the axial first groove width, and wherein an annular first proximal shoulder, which tapers away from the first groove, is located adjacent to the proximal side of the first groove and has an axial width greater than the axial first groove width.

11. The writing apparatus of claim 10, wherein the second coupling means comprises an annular second groove, having a proximal side and a distal side and containing a second O-ring, having the O-ring diameter, wherein the second groove has an axial second groove width, and wherein an annular second proximal shoulder, which tapers toward the second groove, is located adjacent to the proximal side of the second groove and has an axial width less than the axial second groove width, and wherein an annular second distal shoulder, which tapers away from the second groove, is located adjacent to the distal side of the second groove and has an axial width greater than the axial second groove width.

12. The writing apparatus of claim 11, further comprising an annular stop ring, which has a ring diameter, a proximal side and a distal side, wherein the first distal shoulder is located adjacent to the proximal side of the stop ring and has a diameter less than the ring diameter, and wherein the second proximal shoulder is located adjacent to the distal side of the stop ring and has a diameter less than the ring diameter.

13. The writing apparatus of claim 12, wherein the third coupling means comprises an O-ring detent, which has a proximal side and a distal side and is sized and configured to snuggly accept alternately either the first O-ring or the second O-ring, wherein a shorter shoulder ramp is located adjacent to the proximal side of the O-ring detent and is sized and configured to snuggly interface alternately with either the first distal shoulder of the first coupling means or the second proximal shoulder of the second coupling means, and wherein a longer shoulder ramp is located adjacent to the distal side of the O-ring detent and is sized and configured to snuggly interface alternately with either the first proximal shoulder of the first coupling means or the second distal shoulder of the second coupling means.

* * * * *